US011414993B1

(12) United States Patent
Di Paola et al.

(10) Patent No.: US 11,414,993 B1
(45) Date of Patent: Aug. 16, 2022

(54) RETAINING ASSEMBLY WITH ANTI-ROTATION FEATURE

(71) Applicant: PRATT & WHITNEY CANADA CORP., Longueuil (CA)

(72) Inventors: Franco Di Paola, Montréal (CA); Thierry Stocco, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/209,901

(22) Filed: Mar. 23, 2021

(51) Int. Cl.
*F01D 5/06* (2006.01)
*F01D 5/02* (2006.01)

(52) U.S. Cl.
CPC ..... *F01D 5/025* (2013.01); *F01D 5/026* (2013.01); *F01D 5/066* (2013.01); *F05D 2220/32* (2013.01); *F05D 2230/60* (2013.01); *F05D 2240/24* (2013.01); *F05D 2260/36* (2013.01)

(58) Field of Classification Search
CPC ..... F01D 5/025; F01D 5/026; F01D 5/066; F01D 11/003; F01D 11/005; F05D 2240/58; F05D 2240/581; F16J 15/441; F16J 15/442; F16J 15/3272
See application file for complete search history.

(56) References Cited

U.S. PATENT DOCUMENTS 3,222,772 A * 12/1965 Leyner ..... F01D 5/025 464/182
6,009,609 A * 1/2000 Hanno ..... F16D 1/116 464/154
7,112,905 B2 * 9/2006 Chang ..... F04D 25/062 403/DIG. 7
7,811,052 B2 * 10/2010 Guihard ..... F02C 7/36 415/122.1
8,092,312 B2 * 1/2012 Duncan ..... F16D 3/387 464/134
8,459,954 B2 * 6/2013 Anderson ..... F01D 5/3015 29/889.21
8,491,267 B2 * 7/2013 Glasspoole ..... F01D 5/025 416/221

(Continued)

*Primary Examiner* — Woody A Lee, Jr.
*Assistant Examiner* — Behnoush Haghighian
(74) *Attorney, Agent, or Firm* — Norton Rose Fulbright Canada LLP

(57) ABSTRACT

A retention assembly for interconnecting first and second rotating components in a gas turbine engine. The second component includes an engagement portion defining protrusions circumferentially spaced apart and extending axially therefrom. A threaded fastener axially retains the second rotating component to the first and has key-receiving slots and a circumferentially-extending groove. A key washer is mounted to the fastener and defines first and second axial surfaces. The key washer has a first set of keys extending radially inwardly from a radially inner surface and received within the key-receiving slots and a second set of keys extending from the second axial surface. A retaining ring is disposed within the groove, is radially retained by the protrusions extending axially from the second component, axially retained between the second set of keys and the second axial surface, and radially spaced apart from the second set of keys to define a radial gap therebetween.

20 Claims, 10 Drawing Sheets

(56) References Cited

U.S. PATENT DOCUMENTS 8,579,538 B2 * 11/2013 Juh ..... F01D 5/066 403/359.5
8,662,845 B2 * 3/2014 Virkler ..... F01D 5/3015 415/115
8,690,690 B2 * 4/2014 Conger ..... F16D 1/116 464/146
8,840,375 B2 * 9/2014 Virkler ..... F01D 5/066 416/221
8,864,406 B2 * 10/2014 Bolgar ..... F01D 5/06 403/359.1
8,864,591 B2 * 10/2014 Sugiyama ..... F16D 1/116 403/359.5
8,870,489 B2 * 10/2014 Langer ..... F16D 1/108 403/317
8,920,129 B2 * 12/2014 Harbin ..... F16B 39/02 416/244 R
8,932,022 B2 * 1/2015 Ivakitch ..... F01D 5/025 416/204 R
9,022,684 B2 5/2015 Coffin
9,212,562 B2 * 12/2015 Burt ..... F01D 5/3015
9,297,422 B2 * 3/2016 Barnett ..... F01D 5/026
9,745,865 B2 * 8/2017 Lefebvre ..... F01D 25/28
9,970,321 B2 5/2018 Nguyenloc et al.
10,077,716 B2 * 9/2018 Anglin ..... F02C 7/36
10,302,140 B2 * 5/2019 Vinski ..... F16D 1/0894
10,533,612 B2 * 1/2020 Sugiyama ..... F16B 7/00
10,883,545 B2 * 1/2021 Sugiyama ..... F16B 21/186
11,105,204 B2 * 8/2021 Di Paola ..... F01D 5/026
2007/0212226 A1 * 9/2007 Guihard ..... F01D 5/026 416/244 A
2010/0087263 A1 * 4/2010 Bolgar ..... F16D 1/108 464/158
2012/0177495 A1 * 7/2012 Virkler ..... F01D 5/066 416/182
2012/0244004 A1 * 9/2012 Virkler ..... F01D 5/3015 29/888.012
2013/0051986 A1 * 2/2013 Anderson ..... F01D 5/06 415/122.1
2018/0320742 A1 * 11/2018 Hopson ..... F16B 21/186

* cited by examiner

RETAINING ASSEMBLY WITH ANTI-ROTATION FEATURE

TECHNICAL FIELD

The disclosure relates generally to gas turbine engines and, more particularly, to a retaining assembly between rotating components in a gas turbine engine that includes an anti-rotation feature.

BACKGROUND

Retaining assemblies, including for instance threaded fasteners that are locked in place by key washers and retaining rings, are often employed in gas turbine engines to interconnect two rotating components. For instance, a fastener such as a nut is used to axially fasten the two components together while a key washer and retaining ring ensure the fastener remains in place and cannot rotate relative to the component(s) with which is it threadedly engaged. Key washers may provide both radial and axial retention forces for the retaining ring relative to a general rotational axis of the rotating components. To provide both such retention forces, the key washer requires adequate spacing within the gas turbine engine for its retention features. Modern gas turbine engines are typically quite compact, leading to tight spacing for the various components within. In addition, the retention features of a typical key washer often include overhanging parts, which may be subjected to high radial loads in gas turbine engines rotating at high operational speeds, for instance at or over 30,000 RPM.

SUMMARY

In one aspect, there is provided a retention assembly for interconnecting rotating components in a gas turbine engine, comprising: a first rotating component defining a central rotation axis; a second rotating component rotatable about the central rotation axis, the second rotating component including an engagement portion defining protrusions circumferentially spaced apart and extending axially from the second rotating component; a threaded fastener axially retaining the second rotating component to the first rotating component, the threaded fastener having key-receiving slots circumferentially spaced apart and extending radially into an outer circumferential surface of the threaded fastener, and a groove extending circumferentially about the threaded fastener within the outer circumferential surface; a key washer mounted to the threaded fastener, the key washer being annular and defining a first axial surface and a second axial surface axially spaced apart from each other, the key washer having a first set of keys circumferentially spaced apart and extending radially inwardly from a radially inner surface of the key washer adjacent the first axial surface of the key washer, the key washer having a second set of keys circumferentially spaced apart and extending from the second axial surface of the key washer, the first set of keys received within the key-receiving slots in the threaded fastener; and a retaining ring disposed within the groove in the threaded fastener, the retaining ring radially retained by the protrusions extending axially from the second rotating component, the retaining ring axially retained between the second set of keys and the second axial surface of the key washer, the retaining ring radially spaced apart from the second set of keys of the key washer to define a radial gap between the second set of keys and the retaining ring.

The retention assembly as defined above and herein may further include, in whole or in part, and in any combination, one or more of the following features.

In certain embodiments, the key-receiving slots are proximate a first axial edge of the threaded fastener and the groove is proximate a second axial edge of the threaded fastener.

In certain embodiments, the second set of keys includes first portions projecting axially from the second axial surface of the key washer and second portions projecting radially inwardly from the first portions.

In certain embodiments, the key washer includes ninety-degree bends between the first portions and the second portions of the second set of keys.

In certain embodiments, the second rotating component includes slots defined between adjacent protrusions, the second set of keys received in said slots.

In certain embodiments, the first set of keys are arranged in adjacent pairs about the radially inner surface of the key washer, with slots separating respective first set of keys in each adjacent pair.

In certain embodiments, the second rotating components includes an annular flange including the protrusions, the annular flange further including cutouts arranged about an outer circumference of the annular flange.

In certain embodiments, the cutouts are scallop-shaped.

In another aspect, there is provided a retention assembly for interconnecting rotating components in a gas turbine engine, comprising: a first rotating component defining a central rotation axis; a second rotating component rotatable about the central rotation axis, the second rotating component including an engagement portion defining protrusions circumferentially spaced apart and extending axially from the second rotating component; a threaded fastener threaded to the first rotating component and axially retaining the second rotating component and the first rotating component together; and an anti-rotation feature for the threaded fastener, including: a key washer circumscribing an outer circumferential surface of the threaded fastener, the key washer having a first set of keys and a second set of keys, the first set of keys matingly engaging with corresponding key-receiving slots defined in the threaded fastener, the second set of keys matingly engaged with corresponding slots defined in the second rotating component, the key washer thereby preventing rotation of the threaded fastener relative to the first rotating component and the second rotating component; and a retaining ring retaining the key washer in place on the threaded fastener, the retaining ring received within axially aligned grooves defined in the threaded fastener and the key washer, the retaining ring being axially secured in place by the key washer, the retaining ring being radially spaced apart from the second set of keys of the key to define a radial gap between the second set of keys and the retaining ring, the retaining ring radially secured in place by the second rotating component.

The retention assembly as defined above and herein may further include, in whole or in part, and in any combination, one or more of the following features.

In certain embodiments, the first rotating component includes an engagement portion with slots circumferentially spaced about an outer circumference thereof, and wherein the engagement portion of the second rotating component includes retention tabs extending radially inwardly, the retention tabs received in the slots of the engagement portion of the first rotating component.

In certain embodiments, the key-receiving slots are proximate a first axial edge of the threaded fastener and the groove in the threaded fastener is proximate a second axial edge of the threaded fastener.

In certain embodiments, the second set of keys includes first portions projecting axially from an axial surface of the key washer and second portions projecting radially inwardly from the first portions.

In certain embodiments, the retaining ring is axially constrained between the second portions of the second set of keys and a body of the key washer.

In certain embodiments, the radial gap is defined by a radial distance between a radially inner surface of the protrusions and a radially inner surface of the first portions of the second set of keys.

In certain embodiments, the second rotating component has an annular flange including the protrusions, the annular flange further including cutouts arranged about an outer circumference of the annular flange.

In certain embodiments, the cutouts are scallop-shaped.

In certain embodiments, at least one of the cutouts is circumferentially located between pairs of the slots receiving the second set of keys.

In certain embodiments, the engagement portion of the second rotating component further includes slots between adjacent protrusions, the second set of keys received in said slots.

In certain embodiments, the first set of keys are arranged in adjacent pairs about the radially inner surface of the key washer, with slots separating respective first set of keys in each said adjacent pair.

In certain embodiments, the first rotating component is a rotor disc of a high pressure turbine of the gas turbine engine, and the second component is a rotor disc cover plate mounted to the rotor disc by the retention assembly.

In a further aspect, there is provided a method for assembling a retention assembly in a gas turbine engine, comprising: mounting a rotor disc cover plate to a rotor disc; positioning a retaining ring within a groove of a nut; mounting the nut to the rotor disc; torqueing the nut to fasten the rotor disc cover plate to the rotor disc; mounting a key washer over the nut; positioning a first set of keys of the key washer within a plurality of key-receiving slots in the nut; positioning a second set of keys of the key washer within a plurality of slots in the rotor disc cover plate; axially retaining the retaining ring relative to a central longitudinal axis of the gas turbine engine via the second set of keys; and radially retaining the retaining ring relative to the central longitudinal axis of the gas turbine engine via protrusions protruding from the rotor disc cover plate.

BRIEF DESCRIPTION OF THE DRAWINGS

Reference is now made to the accompanying figures in which:

FIGS. 3A-3C are perspective, side schematic and front cross-sectional views, respectively, of a retention assembly for a gas turbine engine;

DETAILED DESCRIPTION

Figure 1:
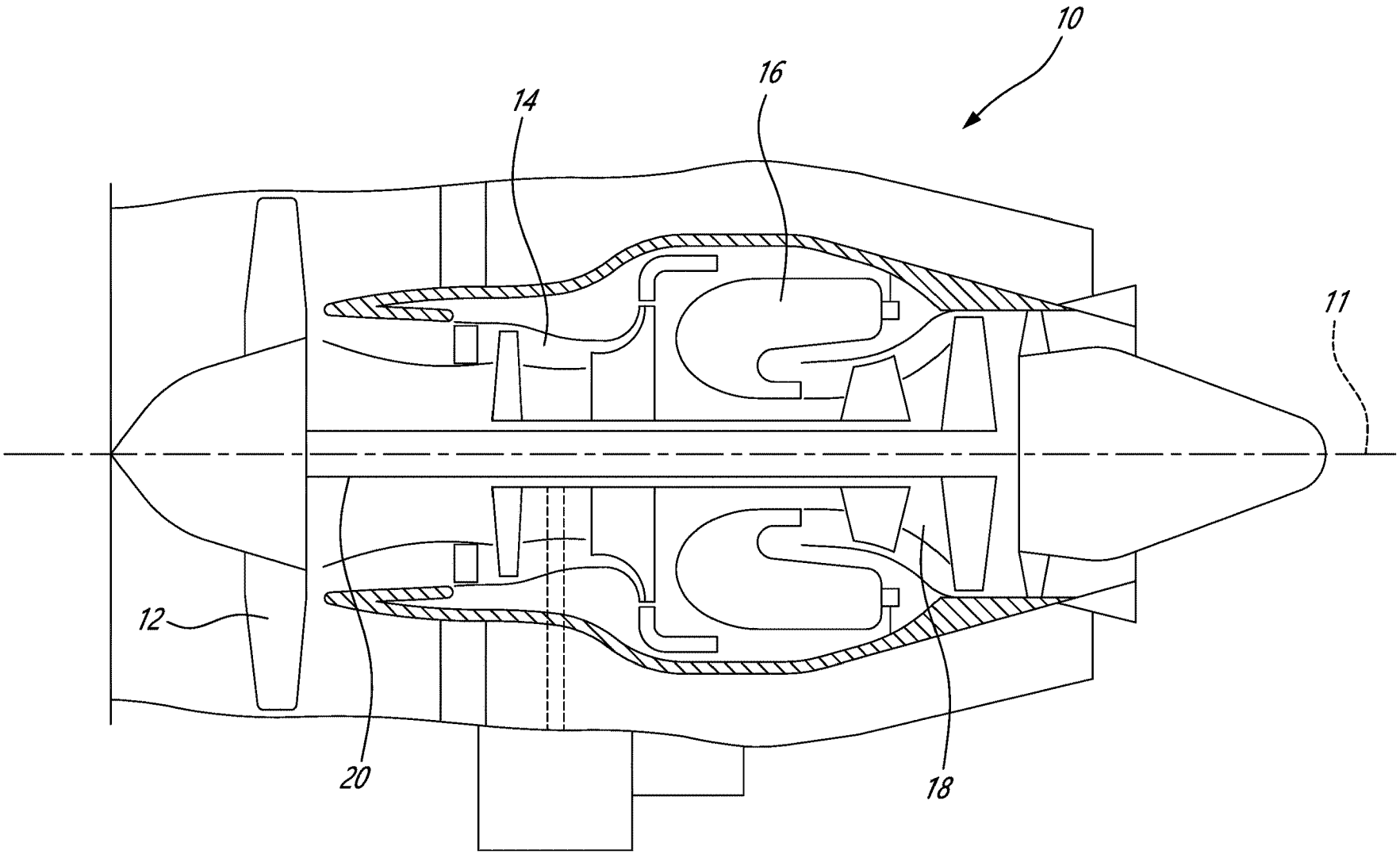
FIG. 1 is a schematic cross sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. A shaft 20 interconnects the fan 12, the compressor section 14 and the turbine section 18. While FIG. 1 shows gas turbine engine 10 to be a turbofan gas turbine engine, it is understood that the present disclosure is applicable to other types of gas turbine engines as well.

Figure 2:
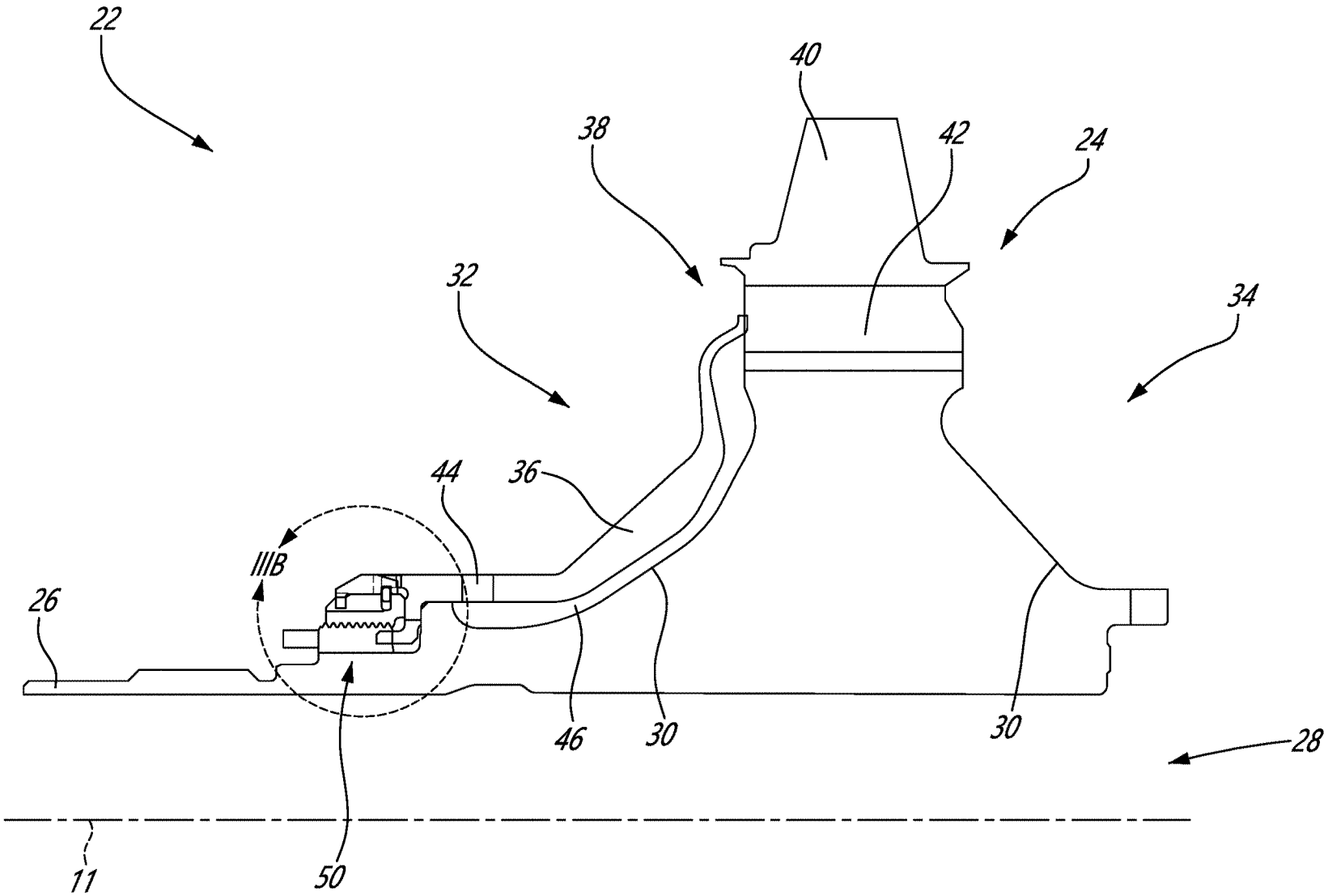
FIG. 2 is a side schematic view of a rotor assembly for a gas turbine engine.

Referring to FIG. 2, a rotor assembly 22 which can be used in the gas turbine engine 10 of FIG. 1 or in any adequate type of gas turbine engine 10 is shown. The rotor assembly 22 is operable for rotation about a central longitudinal axis 11. In the shown embodiment, the rotor assembly 22 is a high pressure turbine (HPT) stage of a multistage turbine section 18 rotating at over 30,000 RPM. However, it is understood that the present disclosure may be applicable to other rotors or other rotating components within a gas turbine engine, as will be discussed in further detail below.

The rotor assembly 22 includes a rotor disc 24 mounted around a drive shaft 20 (shown in FIG. 1). The rotor includes a hub portion 26 having a central bore 28 through which the drive shaft 20 is inserted. The rotor disc 24 includes a frustoconical web portion 30 extending generally radially from the hub portion 26. The rotor disc 24 also has two opposite axially facing faces 32, 34 with reference to the longitudinal axis 11. Opposite faces 32, 34 may be referred to as the first opposite face 32 and the second opposite face 34. The rotor disc 24 includes a rotor disc cover plate 36 mounted to the first opposite face 32. The rotor disc 24 includes an outer periphery portion 38 encircling the web portion 30.

According to one or more embodiments, the rotor assembly 22 includes a plurality of circumferentially-disposed and radially extending blades 40 mounted in corresponding blade-receiving slots 42 provided in the outer periphery portion 38 for receiving roots of the blades 40. The number of blades 40 may vary, for instance based on the type of rotor assembly 22 or the type of engine 10. The slots 42 are designed to prevent the blades 40 from being ejected radially during rotation. Other components (not shown), such as fixing rivets, spring plates, etc., may be provided in the rotor assembly 22, depending on the design. In other cases, blades 40 that are made integral with the rotor, i.e. forming a monolithic assembly, may be contemplated as well.

In the depicted embodiment, the rotor disc cover plate 36 includes an inlet 44 (FIG. 2) to provide a cooling flow to the blades 40 through an annular cooling channel 46 between the rotor disc cover plate 36 and the corresponding web portion 30. Other methods for cooling the blades 40 may be contemplated as well. Due to compact packaging requirements of the gas turbine engine 10, various components such as a carbon seal runner 48 (shown in FIG. 3B) may be positioned adjacent where the rotor disc cover plate 36 attaches to the rotor disc 24. As will be discussed in further detail below, the rotor disc cover plate 36 is mounted to the rotor disc 24, illustratively in front of the first opposite face's 32 web portion 30, via a retention assembly 50.

As will be discussed in further detail below, the retention assembly 50 is operable to retain the rotor disc cover plate 36 to the rotor disc 24 while respecting the limited spacing provided within this section of the gas turbine engine 10, for instance due to the adjacent carbon seal runner 48. In addition, the retention assembly 50 may be operable to accommodate high rotational speeds of the rotating rotor disc 24, for instance speeds of 50,000 RPM or higher. While the shown retention assembly 50 is operable to retain the rotor disc cover plate 36 to the rotor disc 24 of the rotor assembly 22, it is understood that this is an exemplary embodiment. The retention assembly 50 according to the present disclosure may be used to retain various other rotating components within the gas turbine engine 10, for instance where spacing is limited and/or in cases where rotational speeds reach or exceed high values such as 30,000 RPM or more. As such, the retention assembly 50 as per the present disclosure may be used to interconnect a first rotating component (illustratively the rotor disc 24) with a second rotating component (illustratively the rotor disc cover plate 36) disposed about a central rotation axis (illustratively the central longitudinal axis 11 of the gas turbine engine 10). It is understood that other rotating components within the gas turbine engine rotating about other central rotational axes may benefit from the herein described retention assembly 50 as well.

Figure 3A:
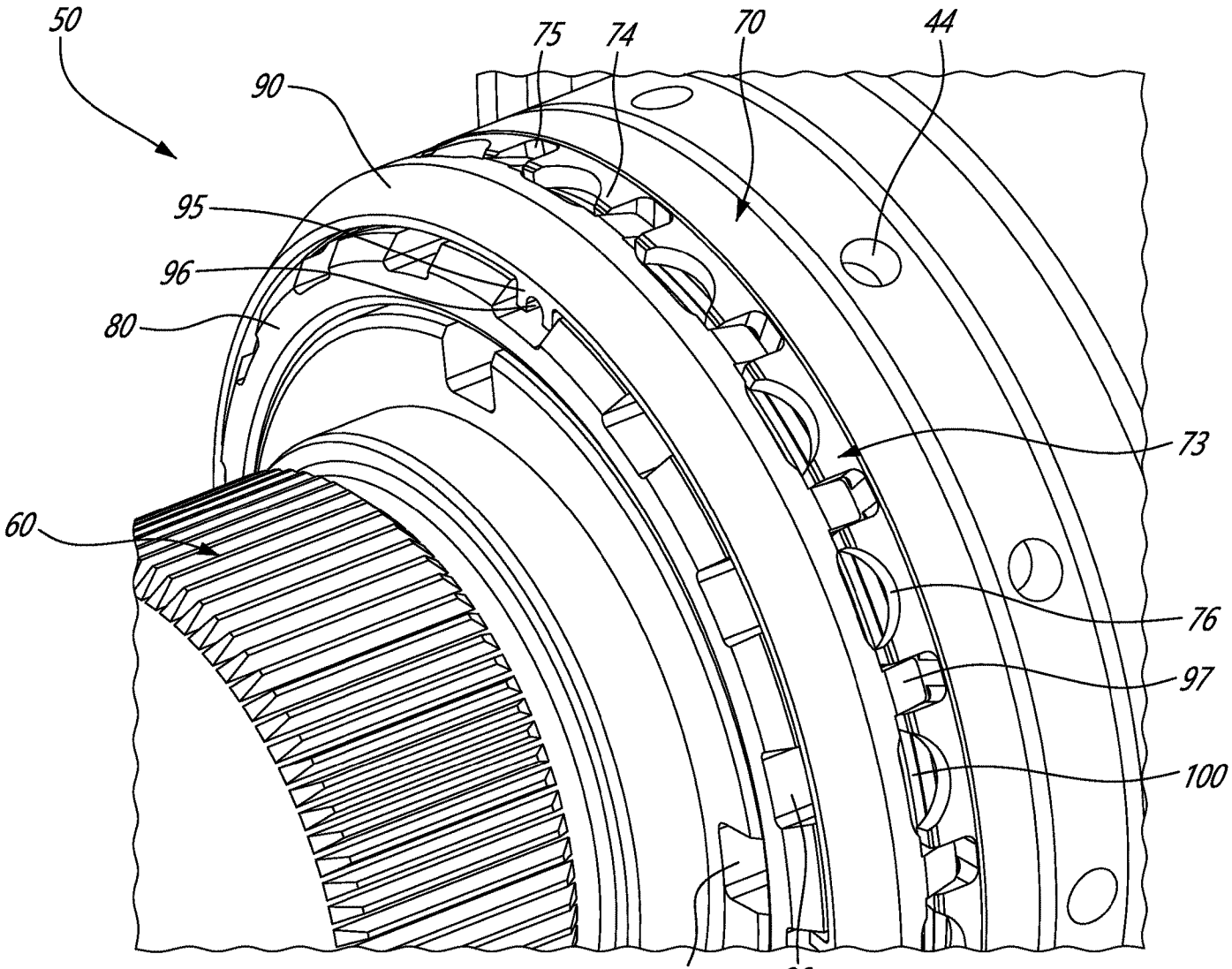
Figure 3B:
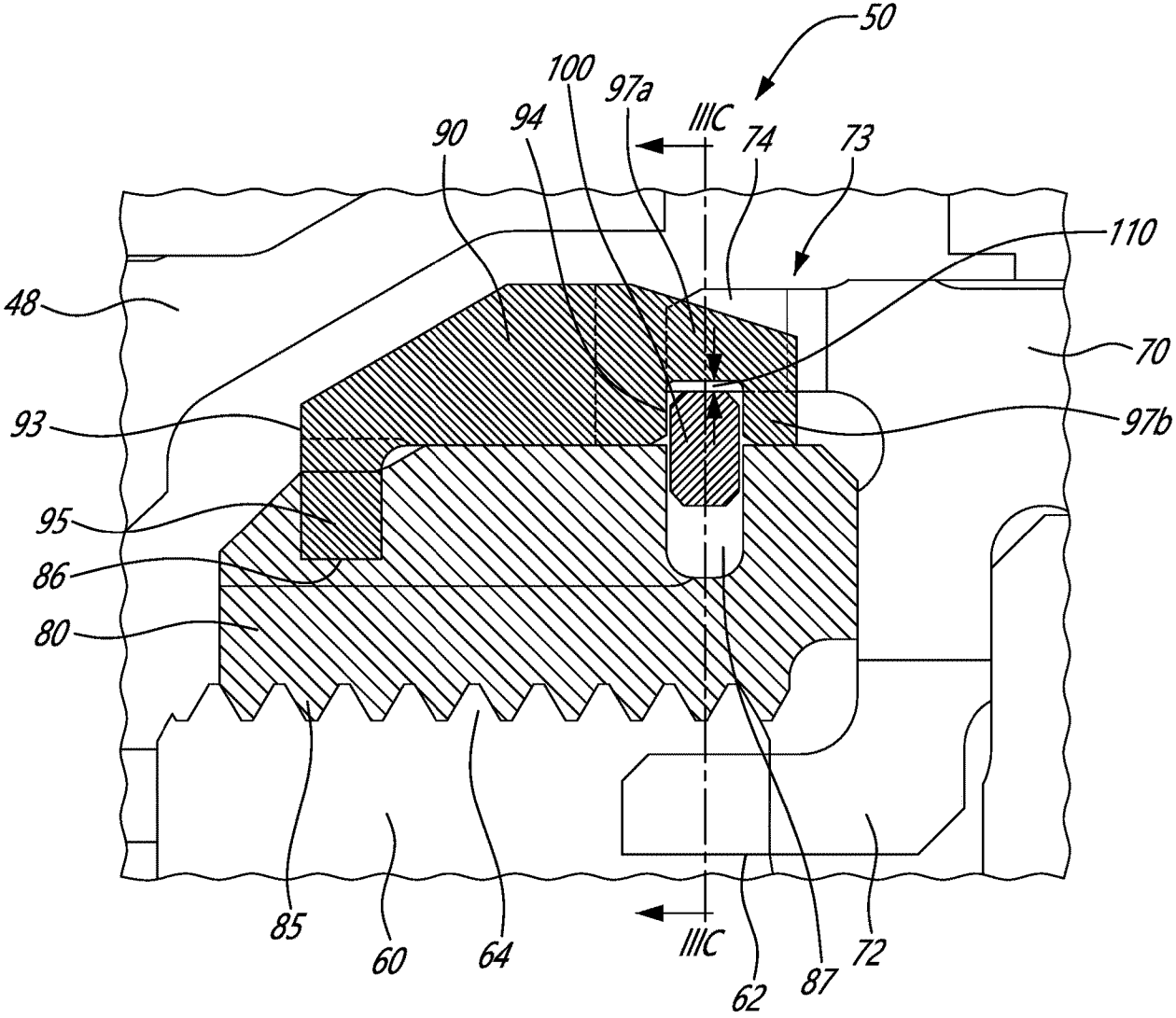
Figure 5H:
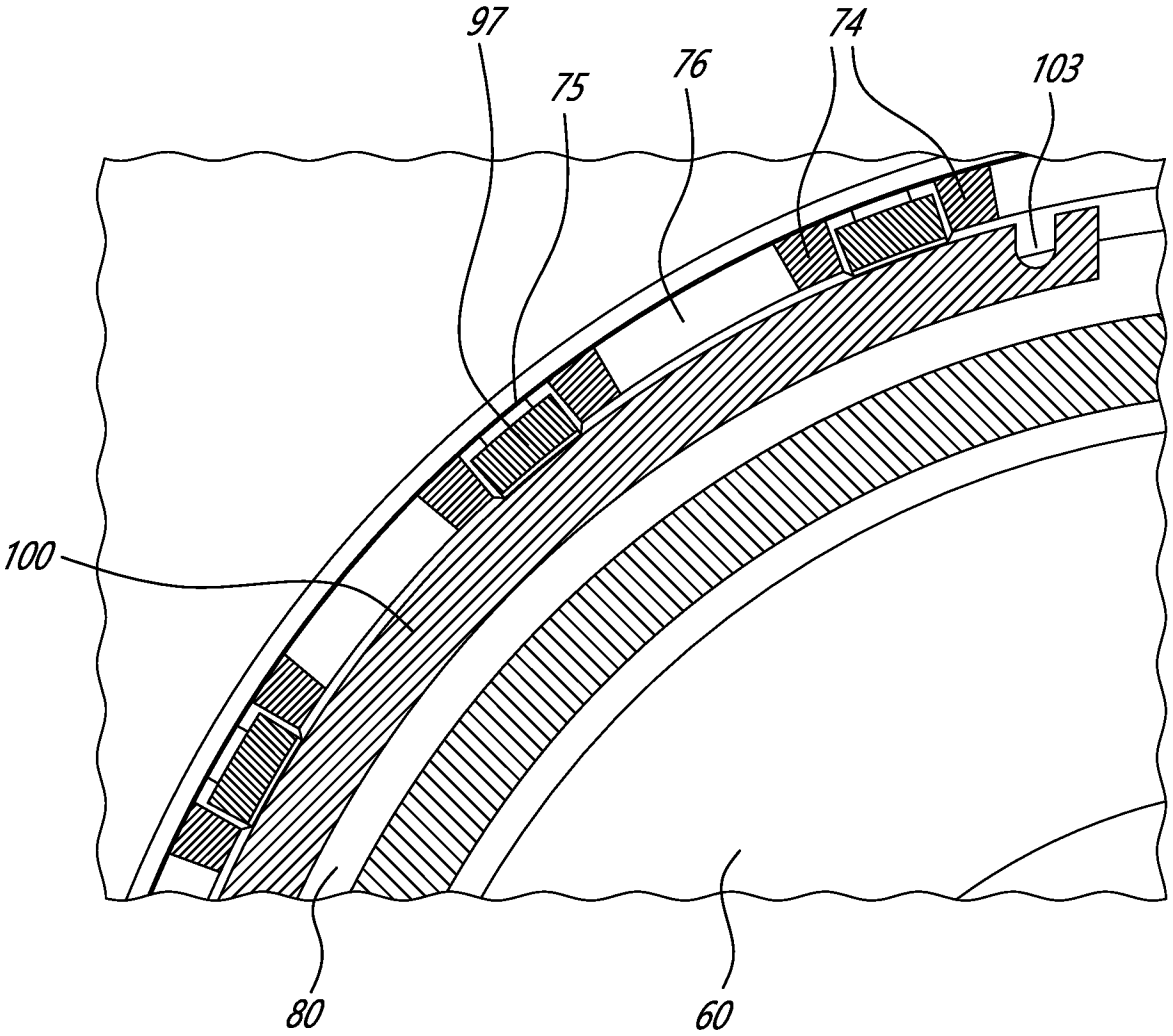
FIG. 5 is a perspective view of a rotor disc cover plate for the rotor assembly of FIG. 2.

Referring to FIGS. 3A-3C, the retention assembly 50 according to an embodiment of the present disclosure is shown in greater detail. The retention assembly 50 is operable to fasten the rotor disc cover plate 36 to the rotor disc 24. Illustratively, a rotor disc engagement portion 60 of the rotor disc 24 is operable to receive and engage with a cover plate engagement portion 70 of the rotor disc cover plate 36. As will be discussed in further detail below, a threaded fastener, illustratively a nut 80, is rotatably mounted to the rotor disc engagement portion 70 upon mounting of the rotor disc cover plate 36 to fasten the rotor disc cover plate 36 to the rotor disc 24. Then, a key washer 90 is mounted to the nut 80 to prevent the nut 80 from rotating, i.e. to ensure the rotor disc cover plate 36 remains fastened to the rotor disc 24. It is understood that the retention assembly 50 may include other types of fasteners to ensure the rotor disc cover plate 36 remains fastened to the rotor disc 24. A retaining ring 100 is mounted to the nut 80 to load the retention assembly 50. As will be discussed in further detail below, the axial and radial retention forces applied to the retaining ring 100 relative to the longitudinal axis 11 are split between the key washer 90 and the cover plate engagement portion 70 of the rotor disc cover plate 36.

Figure 4:
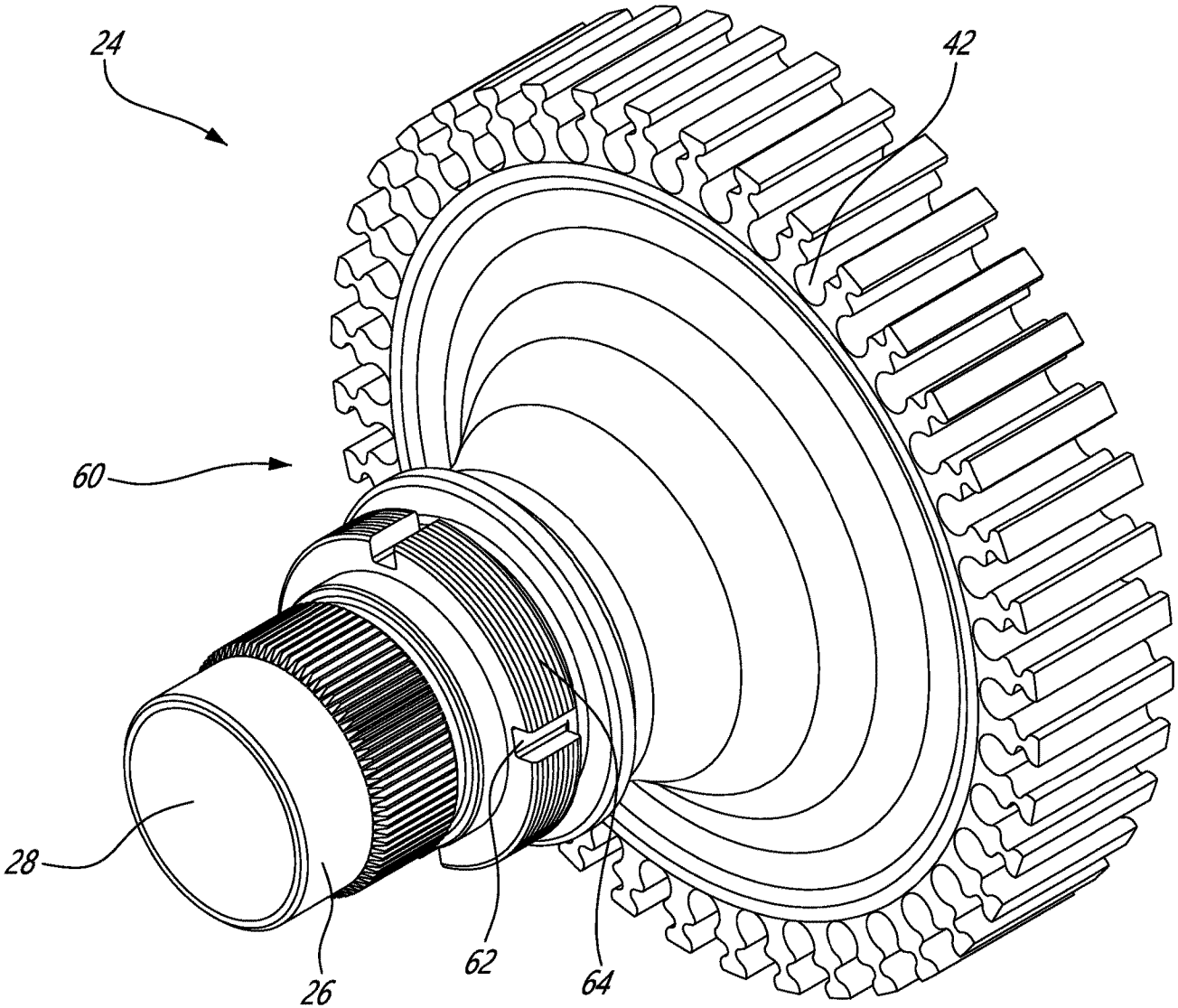
FIG. 4 is a perspective view of a rotor disc for the rotor assembly of FIG. 2.

Referring additionally to FIG. 4, the rotor disc engagement portion 60 of the rotor disc 24 is illustratively a raised annular shoulder disposed about the longitudinal axis 11 between the hub portion 26 and the web portion 30. The rotor disc engagement portion 60 includes a plurality of cover plate-receiving slots 62 circumferentially arranged about the rotor disc engagement portion 60. The slots 62 are operable to engage with corresponding elements of the mounted rotor disc cover plate 36, as will be discussed in further detail below. The number, size and shape of slots 62 may vary, for instance based on the geometry of the corresponding components of the rotor disc cover plate 36. The rotor disc 24 further includes a first set of threads 64 circumferentially disposed about the rotor disc engagement portion 60. The first set of threads 64 is operable to engage with a corresponding set of threads disposed on the nut 80 for secured rotational engagement, as will be discussed in further detail below. In other cases, the first set of threads 64 may be replaced by other suitable fastening elements based on the type of fastener selected. In the depicted embodiment, four slots 62 are axisymmetrically arranged about the rotor disc engagement portion 60 with reference to the longitudinal axis 11, although other arrangements may be contemplated as well.

Figure 5:
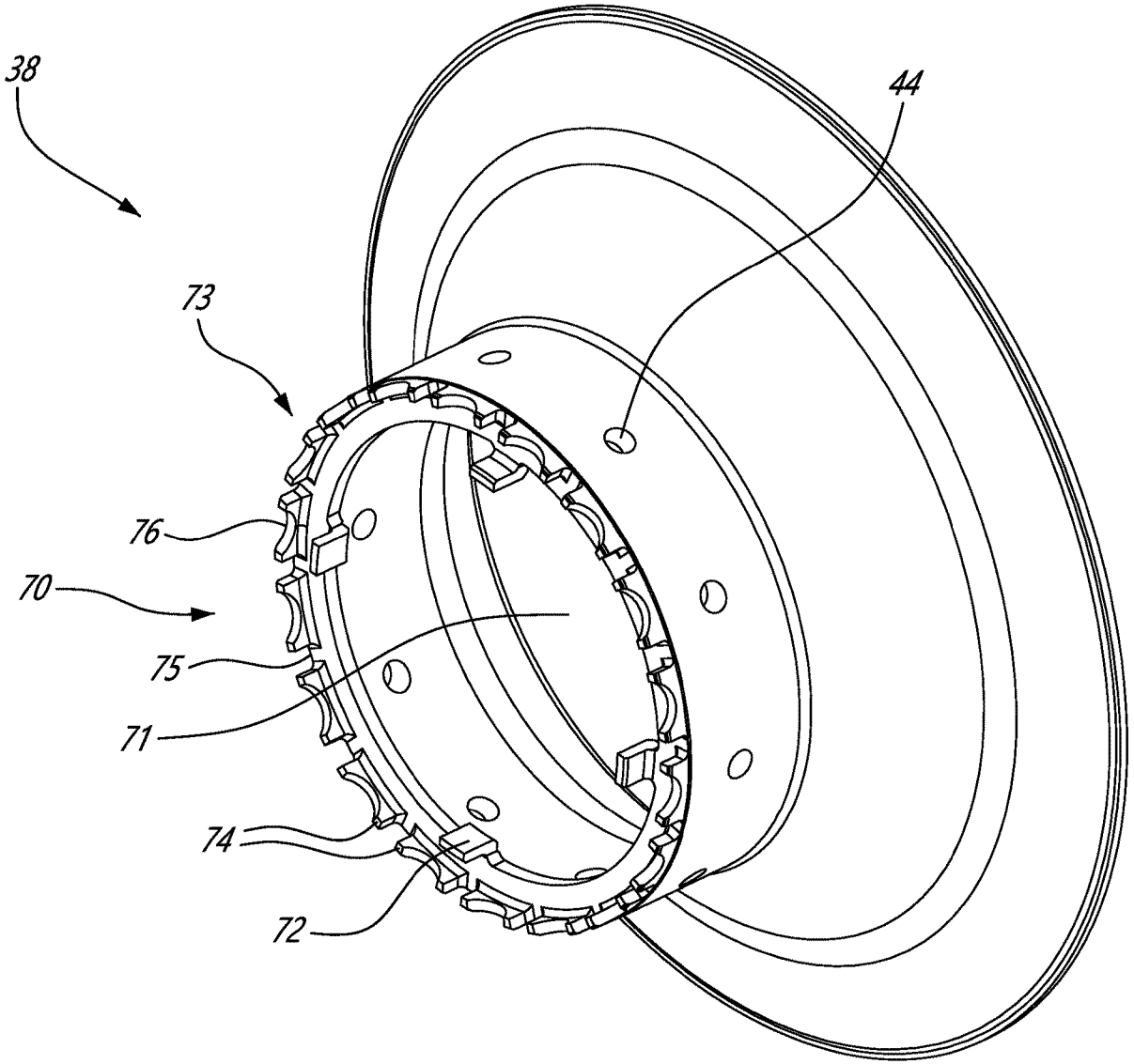

Referring additionally to FIG. 5, the cover plate engagement portion 70 of the rotor disc cover plate 36 is shown to be an annular collar portion of the rotor disc cover plate 36, although other arrangements may be contemplated as well. The cover plate engagement portion 70 is disposed about an opening 71 in the rotor disc cover plate 36 for mounting over the rotor disc's 24 hub portion 26, as will be discussed in further detail below. The cover plate engagement portion 70 includes a plurality of retention tabs 72 arranged about an inner circumference of the cover plate engagement portion 70 and protruding axially relative to the longitudinal axis 11. In the depicted embodiment, four retention tabs 72 are axisymmetrically disposed about the inner circumference of the cover plate engagement portion 70, although other arrangements may be contemplated as well. In the depicted embodiment, the number, arrangement and geometry of the retention tabs 72 correspond to the number, shape and geometry of the slots 62 of the rotor disc engagement portion 60. As such, as the rotor disc cover plate 36 is mounted to the rotor disc 24, the retention tabs 72 received within the slots 62 to prevent rotation of the rotor disc cover plate 36 relative to the rotor disc 24 while allowing the rotor disc cover plate 36 to rotate with the rotor disc 24 as the gas turbine engine 10 operates. In other embodiments, said number, shape and geometry of the slots 62 and corresponding retention tabs 72 may vary.

The cover plate engagement portion 70 further includes an annular flange 73 disposed about the outer circumference of the cover plate engagement portion 70. The annular flange 73 includes a plurality of protrusions 74 spaced apart an outer circumference of the annular flange 73 and protruding or extending axially from an axial surface of the annular flange 73 relative to the longitudinal axis 11. In the depicted embodiment, adjacent pairs of protrusions 74 define cover plate slots 75 therebetween. As will be discussed in further detail below, once the retention assembly 50 is assembled, the cover plate slots 75 are operable to engage with elements of the key washer 90 to prevent rotation of the various components. The size and shape of the cover plate slots 75 may vary, for instance based on the geometry of the corresponding elements of the key washer 90. In the depicted embodiment, between said adjacent pairs of protrusions 74 are defined scalloped cutouts 76, for instance to reduce stresses within the rotor disc cover plate 36 and/or to provide access to the retaining ring 100 once the retention assembly 50 is assembled. Other cutout shapes may be contemplated as well. As will be discussed in further detail below, once the retention assembly 50 is assembled, the protrusions 74 are operable to engage with the retaining ring 100 to retain the retaining ring 100 in place in a radial direction relative to the longitudinal axis 11. Other numbers, sizes, geometries and positions of the various retention tabs 72, protrusions 74, cover plate slots 75 and scalloped cutouts 76 may be contemplated as well.

Figure 6:
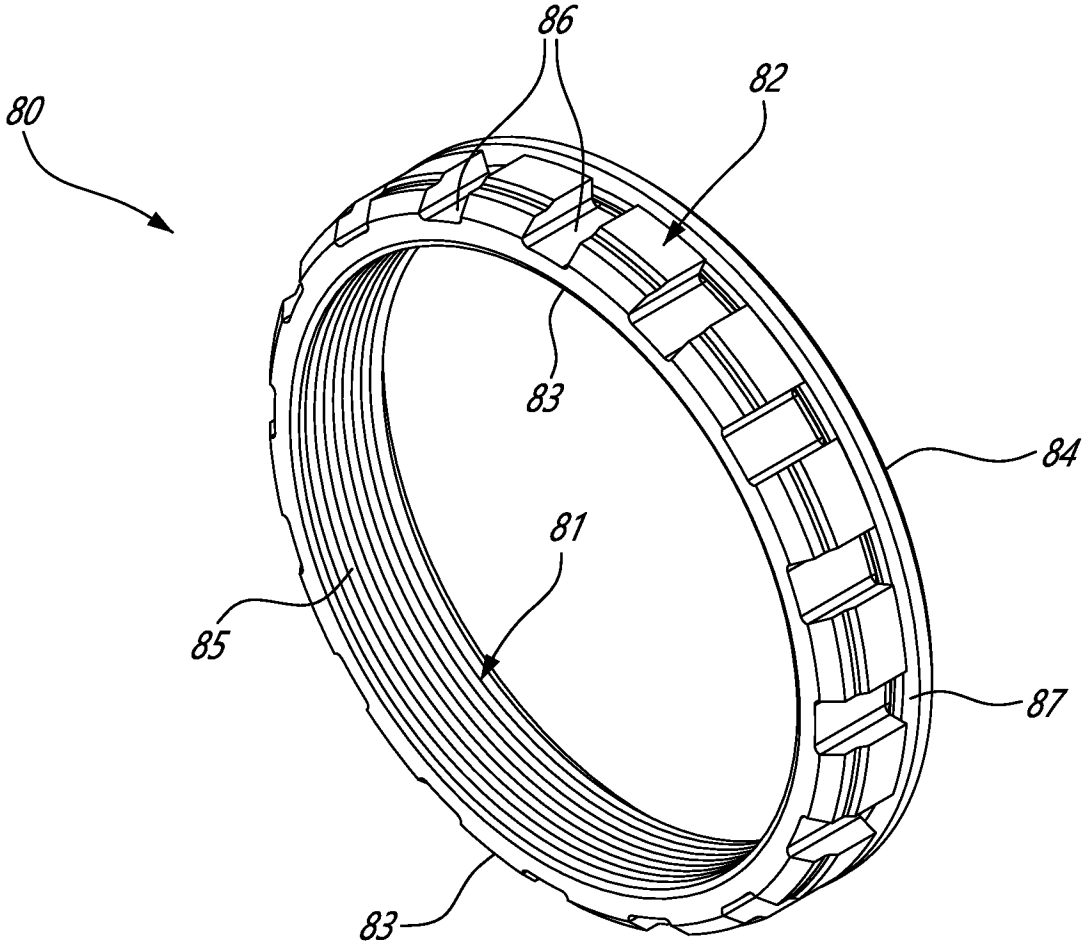
FIG. 6 is a perspective view of a fastener for the retention assembly of FIGS. 3A-3C.

Referring additionally to FIG. 6, as discussed above, an exemplary threaded fastener for the retention assembly 50 is a nut 80. In other cases, other threaded fasteners may be contemplated as well. Illustratively, the nut 80 resembles an annular ring having a radially inner surface 81 and a radially outer surface 82 or outer circumferential surface 82, each extending between a first axial edge 83 and a second axial edge 84 relative to the longitudinal axis 11. A second set of threads 85 are disposed along the radially inner surface 81 of the nut. The second set of threads 85 corresponds with and are thus engageable to the first set of threads 64 on the rotor disc engagement portion 60 of the rotor disc 24. As such, the nut 80 is rotatably securable to the rotor disc 24 at the rotor disc engagement portion 60. The diameter and pitch of the first and second sets of threads 64, 85 may vary, for instance based on the specific application for the retention assembly 50.

The shown nut 80 further incudes a plurality of key-receiving slots 86 circumferentially spaced apart about the radially outer surface 82 of the nut 80 towards the first axial edge 83 of the nut 80. As will be discussed in further detail below, upon assembly of the retention assembly 50 with the nut 80 suitably fastened, the key-receiving slots 86 are engageable with elements of the key washer 90 to prevent rotation, i.e. unfastening, of the nut 80. As such, the key-receiving slots 86 in the nut 80 are open towards the first axial edge 83 to facilitate such engagement. The number, size, position and shape of the key-receiving slots 86 may vary, for instance based on the geometry of the key washer 90. The nut 80 further incudes a groove 87 extending circumferentially about the outer circumferential surface 82 of the nut 80 towards the second axial edge of the nut 80. As will be discussed in further detail below, upon assembly of the retention assembly 50, the retaining ring 100 is insertable in the groove 87 of the nut 80. The size, position and shape of the groove 87 may vary, for instance based on the geometry of the retaining ring 100.

Figure 7:
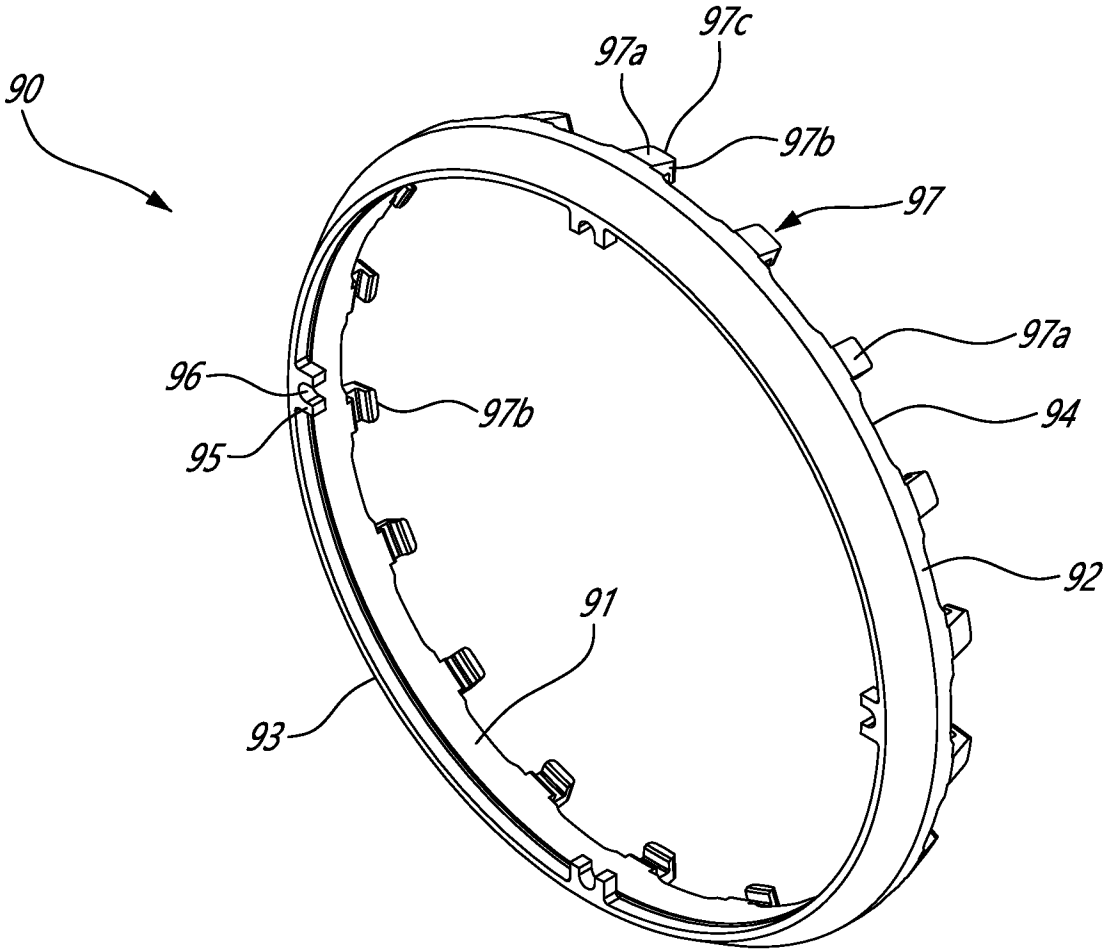
FIG. 7 is a perspective view of a key washer for the retention assembly of FIGS. 3A-3C.

Referring additionally to FIG. 7, an exemplary key washer 90 for the retention assembly 50 is shown. The key washer 90 has an annular body with a radially inner surface 91, a radially outer surface 92, a first axial surface 93 and a second axial surface 94 relative to the longitudinal axis 11. The shown key washer 90 includes a plurality of first set of keys 95 circumferentially spaced apart and extending radially inwardly from the radially inner surface 91 of the key washer 90 adjacent the first axial surface 93. In the depicted embodiment, four pairs of first set of keys 95, each pair with a key slot 96 defined therebetween, are disposed at approximately ninety degree intervals along the circumference of the key washer 90 and protrude radially inwardly relative to the longitudinal axis 11. Other numbers and locations the first set of keys 95 may be contemplated as well. As discussed above, the first set of keys 95 are insertable into the key-receiving slots 86 in the nut 80 to prevent the assembled nut 80 from unwinding, i.e. to prevent the first set of threads 64 and the second set of threads 85 from unthreading. In the depicted embodiment, the width of each pair of first set of keys 95 roughly corresponds to the width of the key-receiving slots 86 for a snug fit. In other cases, the key washer 90 may include a plurality of individual first set of keys 95 with widths corresponding to the widths of the key-receiving slots 86 in the nut 80. In the depicted embodiment, the number of key-receiving slots 86 exceeds the number of first set of keys 95, for instance to facilitate insertion of the first set of keys 95 in a given key-receiving slot 86 regardless of circumferential orientation. Other ratios of first set of keys 95 to key-receiving slots 86 may be contemplated as well.

The key washer 90 further includes a plurality of second set of keys 97 circumferentially spaced apart and extending axially from the second axial surface 94 of the key washer 90. In the depicted embodiment, the second set of keys 97, also referred to as 'lugs', are hook-shaped, i.e. they include a first portion 97*a* projecting axially from second axial surface 94 relative to the longitudinal axis 11 and a second portion 97*b* projecting radially inwardly from the first portion 97*a* relative to the longitudinal axis 11. In the depicted embodiment, each of the second set of keys 97 includes a ninety-degree bend 97*c* between the first portion 97*a* and second portion 97*b*. Other angles between the first portions 97*a* and second portions 97*b* or types or joining members may be contemplated as well, for instance curved joining members. As will be discussed in further detail below, when the retention assembly 50 is in an assembled configuration, the key washer 90 is operable to retain or support the retaining ring 100 in an axial direction relative to the longitudinal axis 11. As shown in FIG. 3B, the retaining ring 100 is radially seated relative to the longitudinal axis 11 between the second axial surface 94 and the second portion 97*b* of the second set of keys 97. While FIG. 3B shows a slight gap between the retaining ring 100 and the key washer 90 in the axial direction, it is understood that as the rotor disc 24 rotates, various forces cause the retaining ring 100 to move within the groove 87 and abut the key washer 90 in the axial direction, i.e. the second axial surface 94 and/or the second set of keys 97. In addition, as shown in FIG. 3A, in the assembled configuration of the retention assembly 50, each retaining ring key 97 is positioned in a cover plate slot 75 between a pair of adjacent protrusions 74. As such, the positioning of the first set of keys 95 within the key-receiving slots 86 and the retaining ring keys 97 within the cover plate slots 75 prevents the nut 80 from rotating or unwinding once the nut 80 is torqued.

Figure 8:
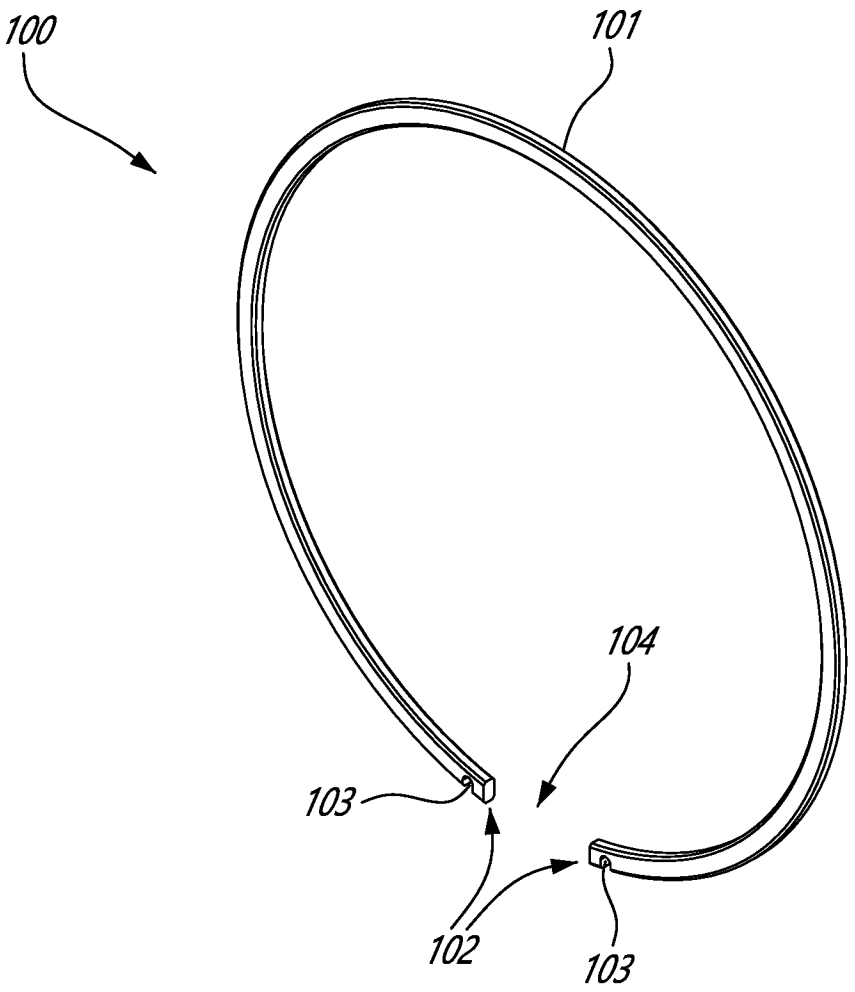
FIG. 8 is a perspective view of a retaining ring for the retention assembly of FIGS. 3A-3C.

Referring additionally to FIG. 8, an exemplary retaining ring 100 for the retention assembly 50 is shown. The shown retaining ring 100 includes a ring-like main body 101 terminating in end portions 102 with external notches 103 defining a gap 104 therebetween. Other configurations for the end portions 102 of the retaining ring 100 may be contemplated as well, for instance internal notches or lug holes. As shown in FIG. 3B, in the retention assembly's 50 assembled configuration, the retaining ring 100 is insertable in the groove 87 of the nut 80. As such, the retaining ring 100 may aid, for instance, in reducing vibrations within the retention assembly 50, in retaining the various components of the retention assembly 50 together, and in withstanding various radial and axial loads from the retention assembly 50.

After the retaining ring 100 is installed into the groove 87, it may rise or pop radially outwardly from the groove 87 relative to the longitudinal axis 11, as shown in FIG. 3B, and abut the protrusions 74. As such, as discussed above, the rotor disc cover plate 36 provides radial retention (with respect to the longitudinal axis 11) to the retaining ring 100 via the protrusions 74 abutting the retaining ring 100. Similarly, as shown in FIG. 3B, the key washer 90 provides axial retention (with respect to the longitudinal axis 11) to the retaining ring 100 via the second axial surface 94 and second portions 97*b* of the second set of keys 97. As such, the radial and axial retention forces are separated or decoupled between two components, illustratively the rotor disc cover plate 36 and the key washer 90. Such decoupling may, for instance, allow for a more compact key washer 90 design to avoid interference with various adjacent components such as the carbon seal runner 48. As shown in FIGS. 3A-3B, various pockets are circumferentially formed to retain or support the retaining ring 100, each pocket formed by one or more protrusions 74, a portion of the second axial surface 94 and one of the second portions 97*b* of one of the second set of keys 97. As shown in FIG. 3B, in an assembled configuration of the retention assembly 50, a portion of the retaining ring 100 remains disposed within the groove 87 while another portion of the retaining ring 100 protrudes radially outwardly of the groove 87. As such, the portion of the retaining ring 100 that remains disposed or trapped within the groove 87 is subjected to various axial retention forces from the inner axially-facing portions of the groove 87. Such axial retention forces may contribute to the axial retention of the retention ring 100 otherwise provided by the key washer 90.

In an exemplary assembly procedure of the illustrated retention assembly 50, the rotor disc cover plate 36 is first mounted to the rotor disc 24. The opening 71 of the rotor disc cover plate 36 is aligned with the longitudinal axis 11 and the rotor disc cover plate 36 is slid over the hub portion 26 until the cover plate engagement portion 70 is aligned with the rotor disc engagement portion 60. The rotor disc cover plate 36 may be rotated until the retention tabs 72 are aligned with and are received within corresponding cover plate-receiving slots 62. Then, the retaining ring 100 may be positioned in the groove 87 of the nut 80, for instance via pliers (not shown) engaging the notches 103 to widen the gap 104. Then, the nut 80 is positioned on the rotor disc 24 with the second set of threads 85 engaging with the first set of threads 64. The nut 80 is torqued, thus locking or retaining the rotor disc cover plate 36 to the rotor disc 24. The key washer 90 is then slipped over the nut 80 and positioned so that the first set of keys 95 engage with the key-receiving slots 86 in the nut 80 to lock the nut 80, i.e. to prevent the nut 80 from unwinding. The pliers may be used to narrow or collapse the gap 104 at this stage, causing the retaining ring 100 to sit deeper within the groove 87 so that the key washer 90 can slide over the retaining ring 100. The retaining ring 100 may then pop or rise radially outwardly relatively (relative to the longitudinal axis 11) in the groove 87 and abut against the protrusions 74, the protrusions 74 thus radially retaining the retaining ring 100. The key washer is concurrently positioned so that the second set of keys 97 are disposed in the cover plate slots 75. As shown in FIG. 3B, the retaining ring 100 sits axially and is thus retained between the second axial surface 94 and the second portions 97*b* of the second set of keys 97 of the key washer 90 relative to the longitudinal axis 11, providing the axial retention of the retention assembly 50. The above assembly steps may be carried out in a variety of orders. Other assembly steps may be contemplated as well.

As shown in FIG. 3B, the illustrated key washer 90 does not make contact with the retaining ring 100 in the radial direction with respect to the longitudinal axis 11 as the retaining ring 100 sits in the groove 87 of the nut 80. The retention assembly 50 is dimensioned so that, once assembled, the first portion 97*a* of the second set of keys 97 of the key washer 90 are positioned radially further from the longitudinal axis than the protrusions 74 which abut the retaining ring 100. As such, as the retaining ring 100 radially rises or pops radially outwardly within the groove 87, it abuts the protrusions 74, forming a gap 110 between the radially outward surface of the retaining ring 100 and the radially inner surface of the first portion 97*a*. In the embodiment shown in FIG. 3B, the radial gap 110 is defined by a radial distance between a radially inner surface of the protrusions 74 and a radially inner surface of the first portions 97*a* of the second set of keys 97. As such, the key washer 90 contributes only to the axial retention of the retaining ring 100 and not to the radial retention of the retaining ring 100 relative to the longitudinal axis 11. Conversely, the protrusions 74 contribute only to the radial retention of the retaining retention of the retaining ring 100 and not to the axial retention of the retaining ring 100 relative to the longitudinal axis 11. As discussed above, the axial and radial retention of the retaining ring 100 is decoupled between the key washer 90 and the rotor disc cover plate 36. As such, the retention assembly 50 may be suitable to retain rotating components where axial spacing is tight, for instance in the depicted embodiment where the adjacent carbon seal runner 48 limits the axial spacing where the rotor disc cover plate 36 meets the rotor disc 24. In addition, the compact nature of the retention assembly 50, for instance the lack of overhanging features of the key washer, may render the retention assembly 50 suitable for applications where the rotating components such as the rotor disc 24 spin at high speeds such as 50,000 RPM or higher.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A retention assembly for interconnecting rotating components in a gas turbine engine, comprising:

a first rotating component defining a central rotation axis;

a second rotating component rotatable about the central rotation axis, the second rotating component including an engagement portion defining protrusions circumferentially spaced apart and extending axially from the second rotating component;

a threaded fastener axially retaining the second rotating component to the first rotating component, the threaded fastener having key-receiving slots circumferentially spaced apart and extending radially into an outer circumferential surface of the threaded fastener, and a groove extending circumferentially about the threaded fastener within the outer circumferential surface;

a key washer mounted to the threaded fastener, the key washer being annular and defining a first axial surface and a second axial surface axially spaced apart from each other, the key washer having a first set of keys circumferentially spaced apart and extending radially inwardly from a radially inner surface of the key washer adjacent the first axial surface of the key washer, the key washer having a second set of keys circumferentially spaced apart and extending from the second axial surface of the key washer, the first set of keys received within the key-receiving slots in the threaded fastener; and a retaining ring disposed within the groove in the threaded fastener, the retaining ring radially retained by the protrusions extending axially from the second rotating component, the retaining ring axially retained between the second set of keys and the second axial surface of the key washer, the retaining ring radially spaced apart from the second set of keys of the key washer to define a radial gap between the second set of keys and the retaining ring.

2. The retention assembly as defined in claim 1, wherein the key-receiving slots are proximate a first axial edge of the threaded fastener and the groove is proximate a second axial edge of the threaded fastener.

3. The retention assembly as defined in claim 1, wherein the second set of keys includes first portions projecting axially from the second axial surface of the key washer and second portions projecting radially inwardly from the first portions.

4. The retention assembly as defined in claim 3, wherein the key washer includes ninety-degree bends between the first portions and the second portions of the second set of keys.

5. The retention assembly as defined in claim 1, wherein the second rotating component includes slots defined between adjacent protrusions, the second set of keys received in said slots.

6. The retention assembly as defined in claim 1, wherein the first set of keys are arranged in adjacent pairs about the radially inner surface of the key washer, with slots separating respective first set of keys in each adjacent pair.

7. The retention assembly as defined in claim 1, wherein the second rotating components includes an annular flange including the protrusions, the annular flange further including cutouts arranged about an outer circumference of the annular flange.

8. The retention assembly as defined in claim 7, wherein the cutouts are scallop-shaped.

9. A retention assembly for interconnecting rotating components in a gas turbine engine, comprising:

a first rotating component defining a central rotation axis;

a second rotating component rotatable about the central rotation axis, the second rotating component including an engagement portion defining protrusions circumferentially spaced apart and extending axially from the second rotating component;

a threaded fastener threaded to the first rotating component and axially retaining the second rotating component and the first rotating component together; and an anti-rotation feature for the threaded fastener, including:

a key washer circumscribing an outer circumferential surface of the threaded fastener, the key washer having a first set of keys and a second set of keys, the first set of keys matingly engaging with corresponding key-receiving slots defined in the threaded fastener, the second set of keys matingly engaged with corresponding slots defined in the second rotating component, the key washer thereby preventing rotation of the threaded fastener relative to the first rotating component and the second rotating component; and a retaining ring retaining the key washer in place on the threaded fastener, the retaining ring received within axially aligned grooves defined in the threaded fastener and the key washer, the retaining ring being axially secured in place by the key washer, the retaining ring being radially spaced apart from the second set of keys of the key to define a radial gap between the second set of keys and the retaining ring, the retaining ring radially secured in place by the second rotating component.

10. The retention assembly as defined in claim 9, wherein the first rotating component includes an engagement portion with slots circumferentially spaced about an outer circumference thereof, and wherein the engagement portion of the second rotating component includes retention tabs extending radially inwardly, the retention tabs received in the slots of the engagement portion of the first rotating component.

11. The retention assembly as defined in claim 9, wherein the key-receiving slots are proximate a first axial edge of the threaded fastener and the groove in the threaded fastener is proximate a second axial edge of the threaded fastener.

12. The retention assembly as defined in claim 9, wherein the second set of keys includes first portions projecting axially from an axial surface of the key washer and second portions projecting radially inwardly from the first portions.

13. The retention assembly as defined in claim 12, wherein the retaining ring is axially constrained between the second portions of the second set of keys and a body of the key washer.

14. The retention assembly as defined in claim 13, wherein the radial gap is defined by a radial distance between a radially inner surface of the protrusions and a radially inner surface of the first portions of the second set of keys.

15. The retention assembly as defined in claim 9, wherein the second rotating component has an annular flange including the protrusions, the annular flange further including cutouts arranged about an outer circumference of the annular flange.

16. The retention assembly as defined in claim 15, wherein the cutouts are scallop-shaped.

17. The retention assembly as defined in claim 15, wherein at least one of the cutouts is circumferentially located between pairs of the slots receiving the second set of keys.

18. The retention assembly as defined in claim 9, wherein the engagement portion of the second rotating component further includes slots between adjacent protrusions, the second set of keys received in said slots.

19. The retention assembly as defined in claim 9, wherein the first set of keys are arranged in adjacent pairs about the radially inner surface of the key washer, with slots separating respective first set of keys in each said adjacent pair.

20. The retention assembly as defined in claim 9, wherein the first rotating component is a rotor disc of a high pressure turbine of the gas turbine engine, and the second component is a rotor disc cover plate mounted to the rotor disc by the retention assembly.

* * * * *